US008545372B2

(12) United States Patent
Wang

(10) Patent No.: US 8,545,372 B2
(45) **Date of Patent: *Oct. 1, 2013**

(54) REHABILITATION EXERCISING EQUIPMENT THAT CAN EXTEND A USER'S ARMS AND LEGS

(75) Inventor: Shih-Jung Wang, Taiping (TW)

(73) Assignee: Preventive Medical Health Care Co., Ltd., Taoyuan County (TW)

( * ) Notice: Subject to any disclaimer, the term of this patent is extended or adjusted under 35 U.S.C. 154(b) by 198 days.

This patent is subject to a terminal disclaimer.

(21) Appl. No.: 13/171,604

(22) Filed: Jun. 29, 2011

(65) Prior Publication Data

US 2013/0005548 A1 Jan. 3, 2013

(51) Int. Cl.

| | |
|---|---|
| ***A63B 22/04*** | (2006.01) |
| ***A63B 22/06*** | (2006.01) |
| ***A63B 22/12*** | (2006.01) |
| ***A63B 69/16*** | (2006.01) |

(52) U.S. Cl.
USPC ..... 482/52; 482/57; 482/62

(58) Field of Classification Search
USPC ..... 482/51–52, 57, 62–63, 92, 133–138, 482/148; 601/23, 33–36
See application file for complete search history.

(56) References Cited

U.S. PATENT DOCUMENTS

| | | | | |
|---|---|---|---|---|
| 4,880,225 | A * | 11/1989 | Lucas et al. | 482/59 |
| 6,852,070 | B1 * | 2/2005 | Herbert | 482/57 |
| 2009/0253558 | A1 * | 10/2009 | Lofgren et al. | 482/51 |

* cited by examiner

*Primary Examiner* — Oren Ginsberg
*Assistant Examiner* — Jennifer M Deichl
(74) *Attorney, Agent, or Firm* — Alan Kamrath; Kamrath IP Lawfirm, P.A.

(57) ABSTRACT

Rehabilitation exercising equipment includes a main frame, a first geared member rotatably mounted on the main frame, a second geared member rotatably mounted on the main frame, a connecting mechanism mounted between the first geared member and the second geared member so that the first geared member and the second geared member are movable in concert with each other, a first idle geared member rotatably mounted on the main frame and connected with the connecting mechanism, a second idle geared member rotatably mounted on the main frame and connected with the connecting mechanism, and two handlebars secured on the first geared member and the second geared member respectively. Thus, a user's hands can hold the handlebars to pivot the handlebars in two opposite directions by connection of the connecting mechanism so as to achieve an exercising or rehabilitating function.

14 Claims, 8 Drawing Sheets

REHABILITATION EXERCISING EQUIPMENT THAT CAN EXTEND A USER'S ARMS AND LEGS

BACKGROUND OF THE INVENTION

1. Field of the Invention

The present invention relates to rehabilitation equipment and, more particularly, to rehabilitation exercising equipment.

2. Description of the Related Art

Conventional rehabilitation equipment comprises a support frame, a pedal portion mounted on the support frame, and a handle portion mounted on the support frame and connected with the pedal portion to move in concert with the pedal portion. Thus, when a user holds the handle portion and treads the pedal portion, the handle portion is driven by the pedal portion to move upward and downward so as to provide a rehabilitating function to the user's two hands. However, when the user's legs are injured, he/she cannot tread the pedal portion to drive the handle portion easily, thereby causing inconvenience to the user, and thereby decreasing the rehabilitating effect of the rehabilitation equipment.

BRIEF SUMMARY OF THE INVENTION

In accordance with the present invention, there is provided rehabilitation exercising equipment, comprising a main frame, a first geared member rotatably mounted on the main frame, a second geared member rotatably mounted on the main frame, a connecting mechanism mounted between the first geared member and the second geared member to connect the first geared member and the second geared member so that the first geared member and the second geared member are movable in concert with each other, a first idle geared member rotatably mounted on the main frame and connected with the connecting mechanism, a second idle geared member rotatably mounted on the main frame and connected with the connecting mechanism, and two handlebars secured on the first geared member and the second geared member to pivot in concert with the first geared member and the second geared member respectively.

The primary objective of the present invention is to provide rehabilitation exercising equipment that can extend a user's arms and legs.

According to the primary advantage of the present invention, a user's two hands can hold the two handlebars to pivot the two handlebars in two opposite directions by connection of the connecting mechanism so as to achieve an exercising or rehabilitating function.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
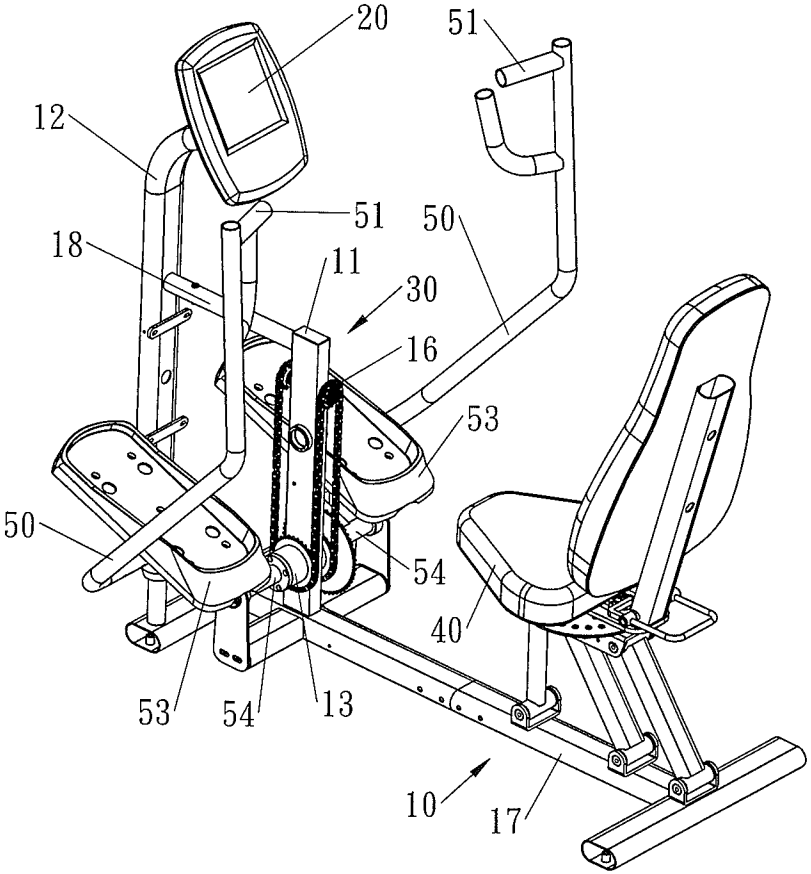
FIG. 1 is a perspective view of rehabilitation exercising equipment in accordance with the preferred embodiment of the present invention.

Referring to the drawings and initially to FIGS. 1-5, rehabilitation exercising equipment in accordance with the preferred embodiment of the present invention comprises a main frame 10, a first geared member 13 rotatably mounted on the main frame 10, a second geared member 14 rotatably mounted on the main frame 10, a connecting mechanism 30 mounted between the first geared member 13 and the second geared member 14 to connect the first geared member 13 and the second geared member 14 so that the first geared member 13 and the second geared member 14 are movable in concert with each other, a first idle geared member 15 rotatably mounted on the main frame 10 and connected with the connecting mechanism 30, a second idle geared member 16 rotatably mounted on the main frame 10 and connected with the connecting mechanism 30, two handlebars 50 secured on the first geared member 13 and the second geared member 14 to pivot in concert with the first geared member 13 and the second geared member 14 respectively, and two pedals 53 connected with the two handlebars 50 to move in concert with the two handlebars 50 respectively.

The main frame 10 includes a transverse bar 17, an upright post 11 mounted on the transverse bar 17, a seat unit 40 swivelably mounted on the transverse bar 17, an extension bar 12 connected with the transverse bar 17, a crossbar 18 mounted between the upright post 11 and the extension bar 12, and a control panel 20 mounted on the extension bar 12. The control panel 20 of the main frame 10 is preferably an electronic instrument panel.

The main frame 10 further includes a first support rod 111 mounted on the upright post 11 to support the first geared member 13 and one of the two handlebars 50, a second support rod 112 mounted on the upright post 11 to support the second geared member 14 and the other one of the two handlebars 50, a third support rod 113 mounted on the upright post 11 to support the first idle geared member 15, and a fourth support rod 114 mounted on the upright post 11 to support the second idle geared member 16.

The first geared member 13 and the second geared member 14 are rotatably mounted on the upright post 11 of the main frame 10 and are rotated in two opposite directions by connection of the connecting mechanism 30. The first geared member 13 and the second geared member 14 are parallel with each other.

The first idle geared member 15 and the second idle geared member 16 are rotatably mounted on the upright post 11 of the main frame 10 and are located above the first geared member 13 and the second geared member 14. The first idle geared member 15 and the second idle geared member 16 are parallel with each other. The first idle geared member 15 and the second idle geared member 16 are perpendicular to the first geared member 13 and the second geared member 14.

The connecting mechanism 30 is connected between the first geared member 13, the second geared member 14, the first idle geared member 15 and the second idle geared member 16. The connecting mechanism 30 includes a first connecting portion 31 meshing with the first geared member 13, a second connecting portion 32 meshing with the second geared member 14, a third connecting portion 33 meshing with the first idle geared member 15 and a fourth connecting portion 34 meshing with the second idle geared member 16.

The first connecting portion 31 and the second connecting portion 32 of the connecting mechanism 30 are parallel with each other. Each of the first connecting portion 31 and the second connecting portion 32 of the connecting mechanism 30 has a substantially U-shaped profile and has a first distal end connected with the third connecting portion 33 and a second distal end connected with the fourth connecting portion 34.

The third connecting portion 33 and the fourth connecting portion 34 of the connecting mechanism 30 are parallel with each other. Each of the third connecting portion 33 and the fourth connecting portion 34 of the connecting mechanism 30 traverses and connects the first connecting portion 31 and the second connecting portion 32 so that the third connecting portion 33 and the fourth connecting portion 34 of the connecting mechanism 30 are perpendicular to the first connecting portion 31 and the second connecting portion 32. Each of the third connecting portion 33 and the fourth connecting portion 34 of the connecting mechanism 30 has a substantially inverted U-shaped profile and has a first distal end connected with the first connecting portion 31 and a second distal end connected with the second connecting portion 32.

Each of the two handlebars 50 has a substantially L-shaped profile. Each of the two handlebars 50 has a lower end provided with a mounting head 54 rotatably mounted on the upright post 11 of the main frame 10 and secured on one of the first geared member 13 and the second geared member 14. The lower end of each of the two handlebars 50 has a side provided with a support plate 52 to support one of the two pedals 53. Each of the two handlebars 50 has an upper end provided with a holding portion 51. The two handlebars 50 are pivoted in two opposite directions by connection of the connecting mechanism 30.

Figure 2:
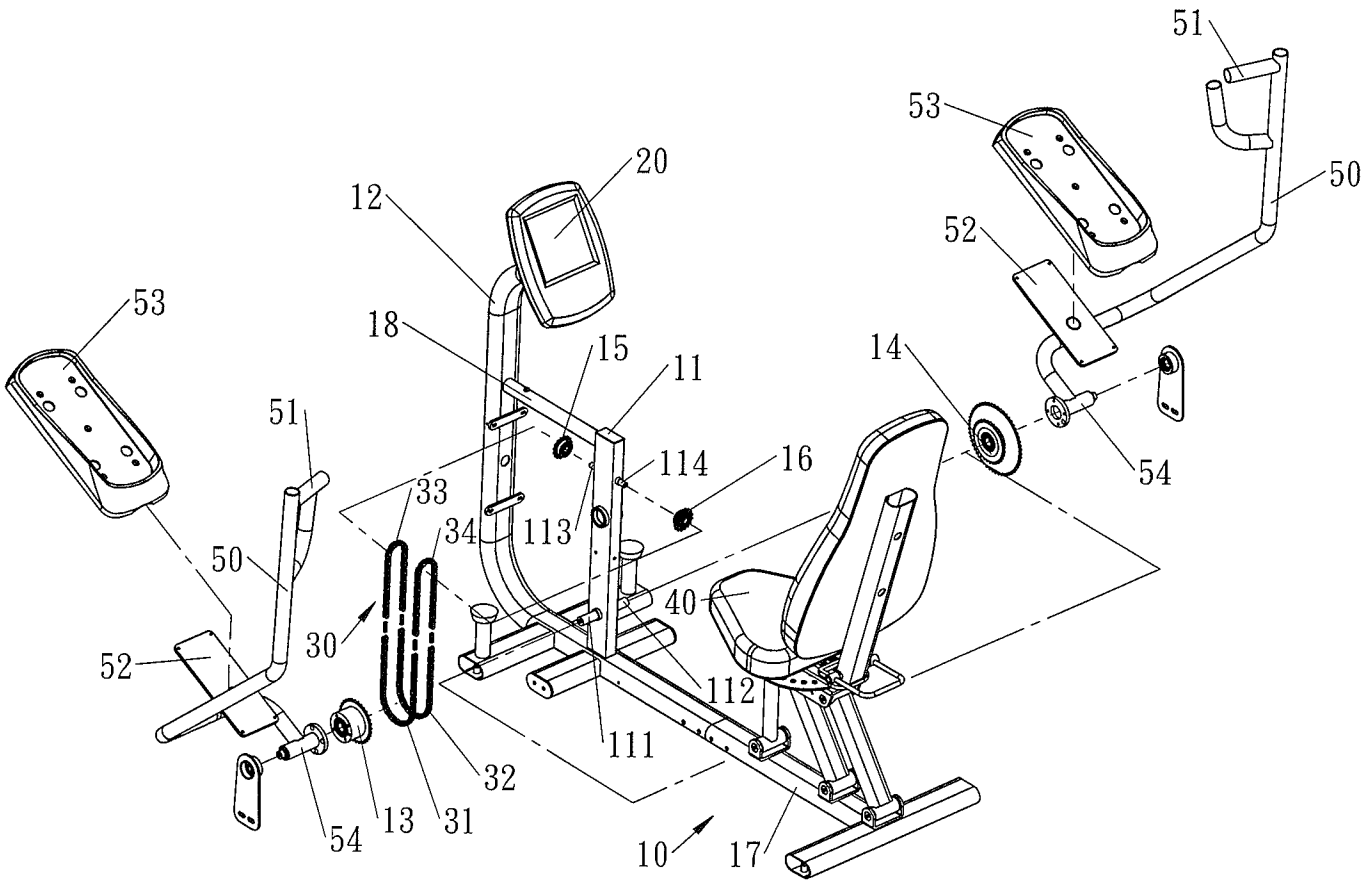
FIG. 2 is an exploded perspective view of the rehabilitation exercising equipment as shown in FIG. 1.
Figure 3:
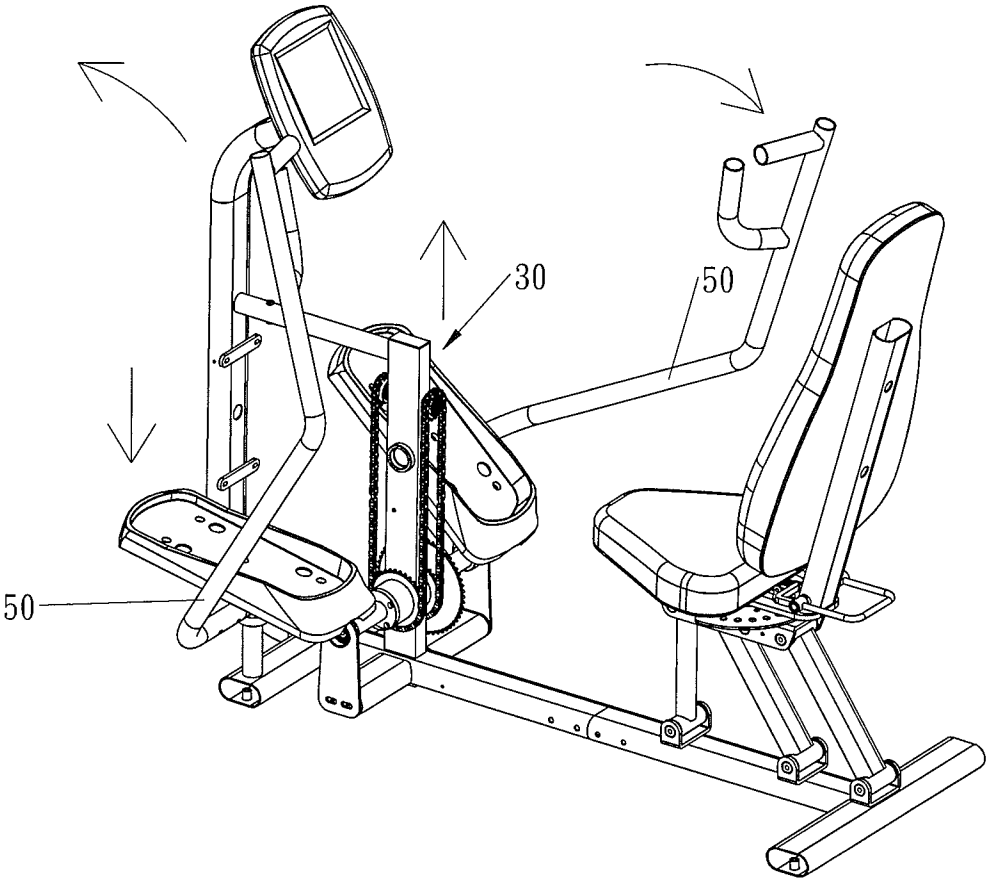
FIG. 3 is a schematic operational view of the rehabilitation exercising equipment as shown in FIG. 1.
Figure 4:
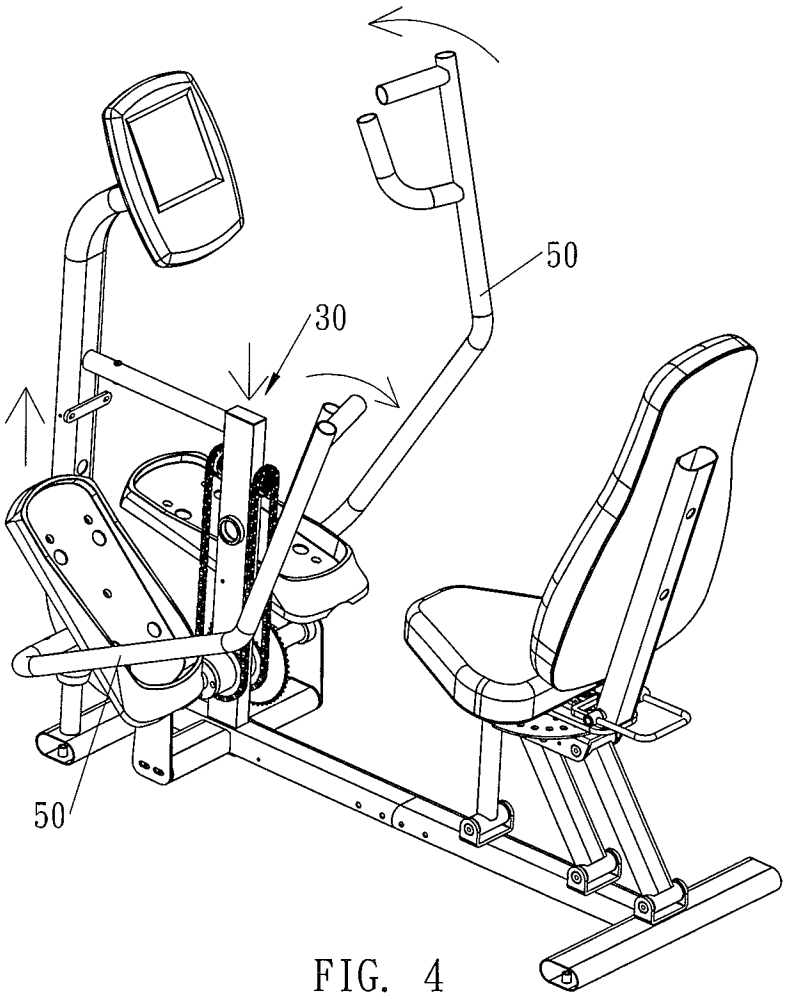
FIG. 4 is a schematic operational view of the rehabilitation exercising equipment as shown in FIG. 1.
Figure 5:
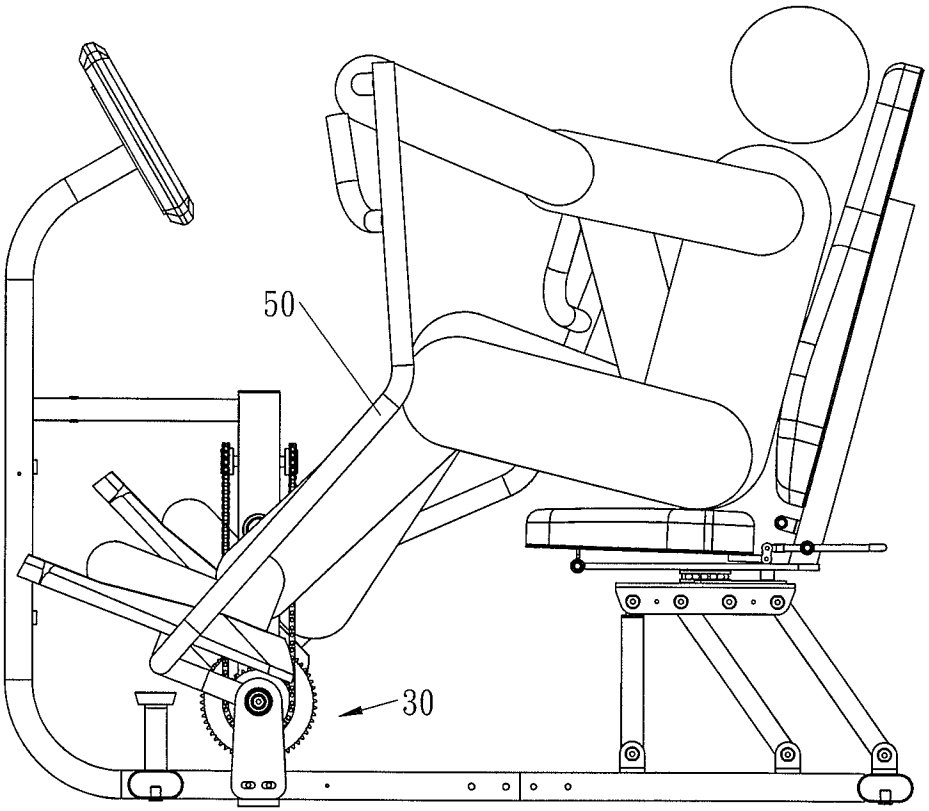
FIG. 5 is a schematic front operational view of the rehabilitation exercising equipment as shown in FIG. 1.

In operation, referring to FIGS. 3-5 with reference to FIGS. 1 and 2, the connecting mechanism 30 is mounted between the first geared member 13, the second geared member 14, the first idle geared member 15 and the second idle geared member 16 so that the first geared member 13 and the second geared member 14 are moved in concert with each other and are moved in two opposite directions. In such a manner, the two handlebars 50 are pivoted about the upright post 11 of the main frame 10 in two opposite directions as shown in FIGS. 3 and 4. Thus, a user's two hands can hold the two handlebars 50 as shown in FIG. 5 to pivot the two handlebars 50 in two opposite directions by connection of the connecting mechanism 30 so as to achieve an exercising or rehabilitating function. In addition, the two pedals 53 are moved in concert with the two handlebars 50 respectively to exercise or rehabilitate the user's two legs.

Figure 6:
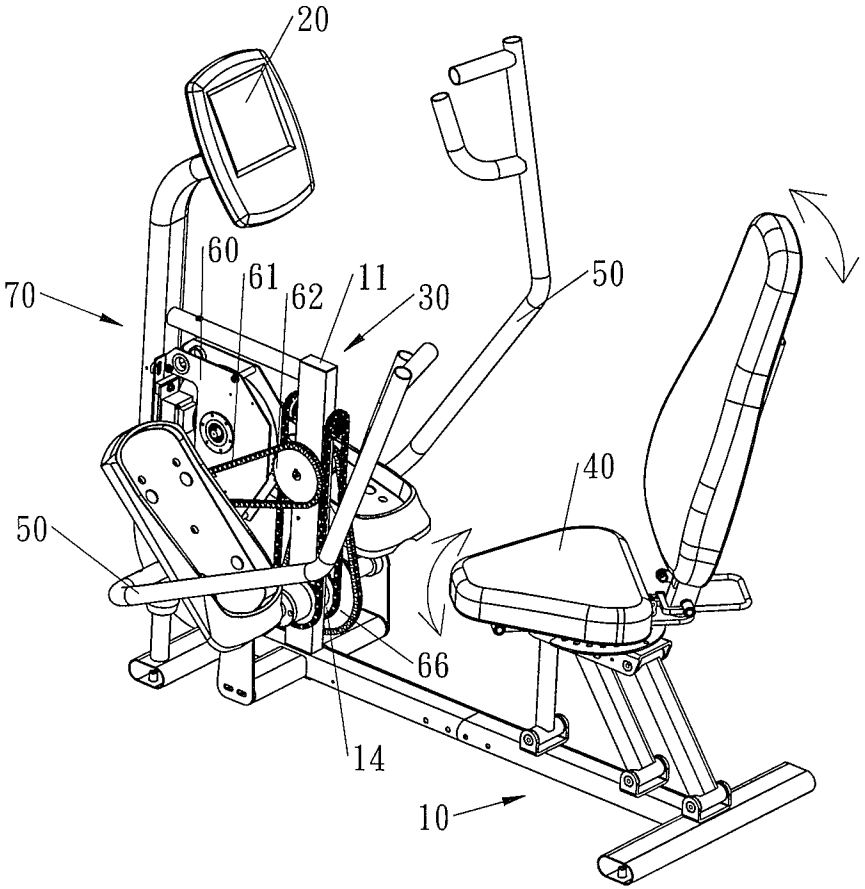
FIG. 6 is a perspective view of rehabilitation exercising equipment in accordance with another preferred embodiment of the present invention.
Figure 7:
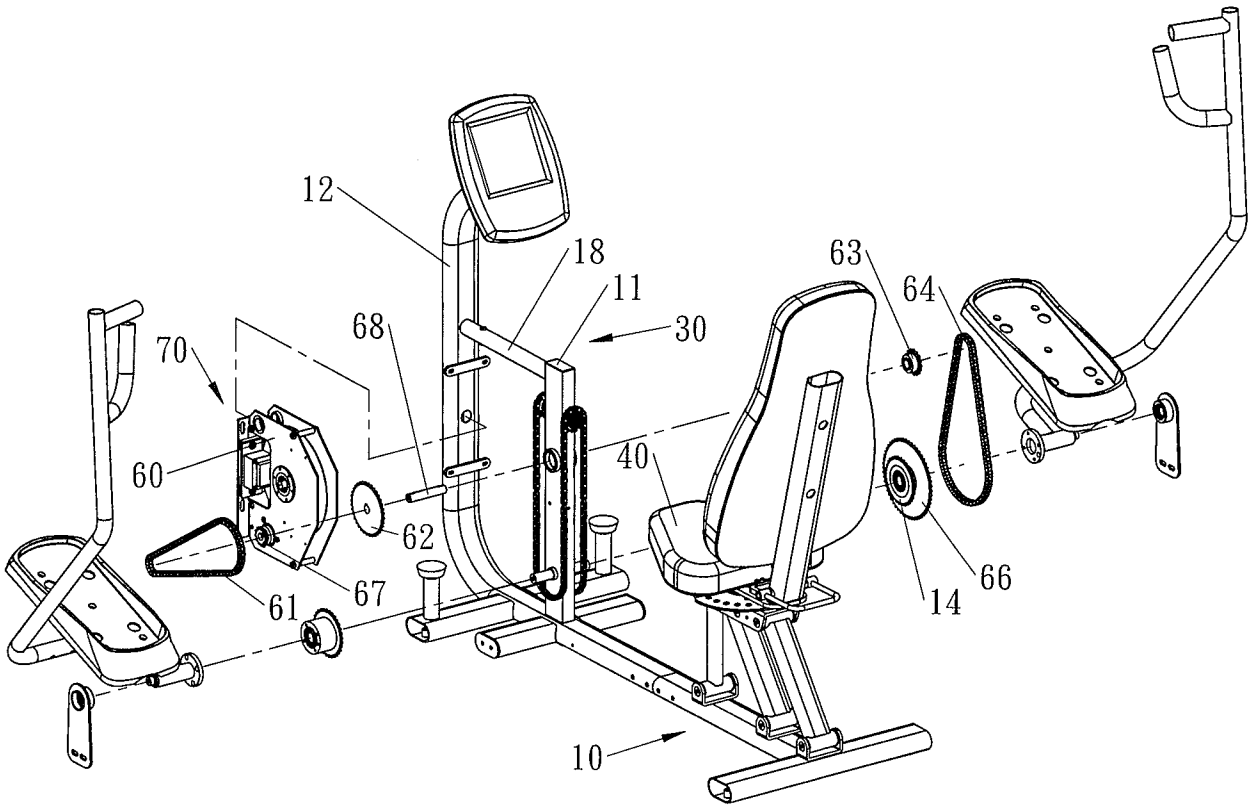
FIG. 7 is an exploded perspective view of the rehabilitation exercising equipment as shown in FIG. 6.
Figure 8:
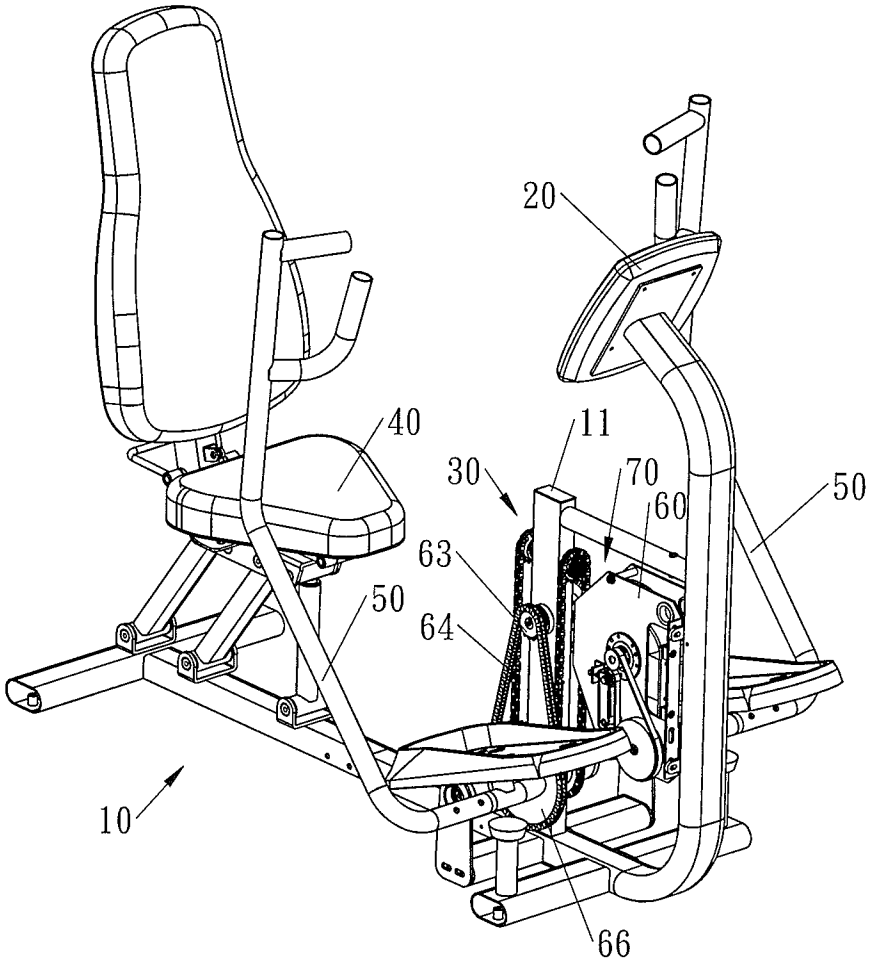
FIG. 8 is another perspective view of the rehabilitation exercising equipment as shown in FIG. 6.

Referring to FIGS. 6-8 with reference to FIGS. 1 and 2, the rehabilitation exercising equipment further comprises a transmission mechanism 70 mounted between the main frame 10 and the second geared member 14. The transmission mechanism 70 includes a first driven geared member 66 secured on the second geared member 14, a rotation shaft 68 rotatably mounted on the main frame 10, a second driven geared member 63 secured on and driven by the rotation shaft 68, a first linking member 64 mounted between the first driven geared member 66 and the second driven geared member 63 to link the first driven geared member 66 and the second driven geared member 63, a drive geared member 62 secured on the rotation shaft 68 to drive the rotation shaft 68, a drive unit 60 mounted on the main frame 10, a driving geared member 67 rotatably mounted on the drive unit 60, and a second linking member 61 mounted between the driving geared member 67 and the drive geared member 62 to link the driving geared member 67 and the drive geared member 62. The rotation shaft 68 of the transmission mechanism 70 is rotatably mounted on the upright post 11 of the main frame 10. The drive unit 60 of the transmission mechanism 70 is received between the upright post 11, the extension bar 12 and the crossbar 18 of the main frame 10.

In the preferred embodiment of the present invention, the drive unit 60 of the transmission mechanism 70 is a magnetically controlled resistance device. Alternatively, the drive unit 60 of the transmission mechanism 70 is a powered motor. In addition, each of the connecting mechanism 30, the first linking member 64 and the second linking member 61 is a toothed belt. Alternatively, each of the first geared member 13, the second geared member 14, the first idle geared member 15, the second idle geared member 16, the first driven geared member 66, the second driven geared member 63, the driving geared member 67 and the drive geared member 62 is a sprocket, while each of the connecting mechanism 30, the first linking member 64 and the second linking member 61 is a chain.

Thus, when the drive unit 60 of the transmission mechanism 70 is a magnetically controlled resistance device, the drive unit 60 provides a magnetic damping force to the first driven geared member 66 by connection of the second linking member 61 and the first linking member 64 to damp rotation of the first geared member 13 and the second geared member 14 and to damp pivot action of the two handlebars 50 so as to provide a resistance to the user's two hands, thereby enhancing the exercising or rehabilitating effect.

Alternatively, when the drive unit 60 of the transmission mechanism 70 is a powered motor, the drive unit 60 drives the driving geared member 67 which drives the second linking member 61 which drives the drive geared member 62 which drives the rotation shaft 68 which drives the second driven geared member 63 which drives the first linking member 64 which drives the first driven geared member 66 which drives the second geared member 14 which drives the connecting mechanism 30 which drives the first geared member 13 so that the two handlebars 50 are moved by the first geared member 13 and the second geared member 14 and are pivoted in two opposite directions by connection of the connecting mechanism 30 to move the user's two hands so as to achieve a rehabilitating function.

As shown in FIG. 6, the seat unit 40 is swiveled rightward and leftward relative to the main frame 10.

Accordingly, a user's two hands can hold the two handlebars 50 to pivot the two handlebars 50 in two opposite directions by connection of the connecting mechanism 30 so as to achieve an exercising or rehabilitating function. In addition, the two pedals 53 are moved in concert with the two handlebars 50 respectively to exercise or rehabilitate the user's two legs. Further, the drive unit 60 of the transmission mechanism 70 functions as a magnetically controlled resistance device to provide a damping force to the first driven geared member 66 by connection of the second linking member 61 and the first linking member 64 to damp rotation of the first geared member 13 and the second geared member 14 and to damp pivot action of the two handlebars 50 so as to provide a resistance to the user's two hands, thereby enhancing the exercising or rehabilitating effect. Further, the drive unit 60 of the transmission mechanism 70 functions as a powered motor to drive the first driven geared member 66 by connection of the second linking member 61 and the first linking member 64 and to drive the second geared member 14 and the first geared member 13 by connection of the connecting mechanism 30 so that the two handlebars 50 are moved by the first geared member 13 and the second geared member 14 and are pivoted in two opposite directions by connection of the connecting mechanism 30 to move the user's two hands so as to achieve a rehabilitating function.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. Rehabilitation exercising equipment, comprising:

a main frame;

a first geared member rotatably mounted on the main frame;

a second geared member rotatably mounted on the main frame;

a connecting mechanism mounted between the first geared member and the second geared member to connect the first geared member and the second geared member so that the first geared member and the second geared member are movable in concert with each other;

a first idle geared member rotatably mounted on the main frame and connected with the connecting mechanism;

a second idle geared member rotatably mounted on the main frame and connected with the connecting mechanism; and two handlebars secured on the first geared member and the second geared member to pivot in concert with the first geared member and the second geared member respectively; wherein:

the main frame includes:

a transverse bar; and an upright post mounted on the transverse bar;

each of the two handlebars has a lower end provided with a mounting head rotatably mounted on the upright post of the main frame and secured on one of the first geared member and the second geared member;

each of the two handlebars has an upper end provided with a holding portion;

the first geared member and the second geared member are parallel with each other;

the first idle geared member and the second idle geared member are parallel with each other;

the first idle geared member and the second idle geared member are perpendicular to the first geared member and the second geared member;

the connecting mechanism includes:

a first connecting portion meshing with the first geared member;

a second connecting portion meshing with the second geared member;

a third connecting portion meshing with the first idle geared member; and a fourth connecting portion meshing with the second idle geared member;

the first connecting portion and the second connecting portion of the connecting mechanism are parallel with each other;

the third connecting portion and the fourth connecting portion of the connecting mechanism are parallel with each other;

each of the third connecting portion and the fourth connecting portion of the connecting mechanism traverses and connects the first connecting portion and the second connecting portion;

the third connecting portion and the fourth connecting portion of the connecting mechanism are perpendicular to the first connecting portion and the second connecting portion.

2. The rehabilitation exercising equipment of claim 1, wherein each of the two handlebars has a substantially L-shaped profile.

3. The rehabilitation exercising equipment of claim 1, wherein the rehabilitation exercising equipment further comprises two pedals connected with the two handlebars to move in concert with the two handlebars respectively;

the lower end of each of the two handlebars has a side provided with a support plate to support one of the two pedals.

4. The rehabilitation exercising equipment of claim 1, wherein the main frame further includes a seat unit swivelably mounted on the transverse bar.

5. The rehabilitation exercising equipment of claim 1, wherein each of the first connecting portion and the second connecting portion of the connecting mechanism has a substantially U-shaped profile and has a first distal end connected with the third connecting portion and a second distal end connected with the fourth connecting portion;

each of the third connecting portion and the fourth connecting portion of the connecting mechanism has a substantially inverted U-shaped profile and has a first distal end connected with the first connecting portion and a second distal end connected with the second connecting portion.

6. The rehabilitation exercising equipment of claim 1, wherein the connecting mechanism is connected between the first geared member, the second geared member, the first idle geared member and the second idle geared member.

7. The rehabilitation exercising equipment of claim 1, wherein the main frame further includes:

a first support rod mounted on the upright post to support the first geared member and one of the two handlebars;

a second support rod mounted on the upright post to support the second geared member and the other one of the two handlebars;

a third support rod mounted on the upright post to support the first idle geared member; and a fourth support rod mounted on the upright post to support the second idle geared member.

8. The rehabilitation exercising equipment of claim 1, wherein the first geared member and the second geared member are rotatably mounted on the upright post of the main frame and are rotated in two opposite directions by connection of the connecting mechanism;

the first idle geared member and the second idle geared member are rotatably mounted on the upright post of the main frame and are located above the first geared member and the second geared member;

the two handlebars are pivoted in two opposite directions by connection of the connecting mechanism.

9. Rehabilitation exercising equipment, comprising:

a main frame;

a first geared member rotatably mounted on the main frame;

a second geared member rotatably mounted on the main frame;

a connecting mechanism mounted between the first geared member and the second geared member to connect the first geared member and the second geared member so that the first geared member and the second geared member are movable in concert with each other;

a first idle geared member rotatably mounted on the main frame and connected with the connecting mechanism;

a second idle geared member rotatably mounted on the main frame and connected with the connecting mechanism; and two handlebars secured on the first geared member and the second geared member to pivot in concert with the first geared member and the second geared member respectively; wherein:

the main frame includes:

a transverse bar; and an upright post mounted on the transverse bar;

each of the two handlebars has a lower end provided with a mounting head rotatably mounted on the upright post of the main frame and secured on one of the first geared member and the second geared member;

each of the two handlebars has an upper end provided with a holding portion;

the rehabilitation exercising equipment further comprises a transmission mechanism mounted between the main frame and the second geared member;

the transmission mechanism includes:

a first driven geared member secured on the second geared member;

a rotation shaft rotatably mounted on the main frame;

a second driven geared member secured on and driven by the rotation shaft;

a first linking member mounted between the first driven geared member and the second driven geared member to link the first driven geared member and the second driven geared member;

a drive geared member secured on the rotation shaft to drive the rotation shaft;

a drive unit mounted on the main frame;

a driving geared member rotatably mounted on the drive unit; and a second linking member mounted between the driving geared member and the drive geared member to link the driving geared member and the drive geared member.

10. The rehabilitation exercising equipment of claim 9, wherein the main frame further includes:

an extension bar connected with the transverse bar;

a crossbar mounted between the upright post and the extension bar; and a control panel mounted on the extension bar;

the drive unit of the transmission mechanism is received between the upright post, the extension bar and the crossbar of the main frame;

the rotation shaft of the transmission mechanism is rotatably mounted on the upright post of the main frame.

11. The rehabilitation exercising equipment of claim 9, wherein the drive unit of the transmission mechanism is a magnetically controlled resistance device.

12. The rehabilitation exercising equipment of claim 9, wherein the drive unit of the transmission mechanism is a powered motor.

13. The rehabilitation exercising equipment of claim 9, wherein each of the connecting mechanism, the first linking member and the second linking member is a toothed belt.

14. The rehabilitation exercising equipment of claim 9, wherein each of the first geared member, the second geared member, the first idle geared member, the second idle geared member, the first driven geared member, the second driven geared member, the driving geared member and the drive geared member is a sprocket;

each of the connecting mechanism, the first linking member and the second linking member is a chain.

* * * * *